US008038469B2

(12) United States Patent
Cedillo Vazquez et al.

(10) Patent No.: US 8,038,469 B2
(45) Date of Patent: Oct. 18, 2011

(54) ELECTRICAL CONNECTION ASSEMBLY

(76) Inventors: Daniel Cedillo Vazquez, Brownsville, TX (US); Luis Hugo Cedillo Vazquez, Brownsville, TX (US)

( * ) Notice: Subject to any disclaimer, the term of this patent is extended or adjusted under 35 U.S.C. 154(b) by 0 days.

(21) Appl. No.: 12/695,638

(22) Filed: Jan. 28, 2010

(65) Prior Publication Data

US 2011/0183533 A1 Jul. 28, 2011

(51) Int. Cl.
*H01R 13/66* (2006.01)

(52) U.S. Cl. ..... 439/535; 439/145

(58) Field of Classification Search ..... 439/106, 439/107, 137, 145, 535, 536
See application file for complete search history.

(56) References Cited

U.S. PATENT DOCUMENTS

| | | | | |
|---|---|---|---|---|
| 2,478,006 | A | 8/1949 | Paden | |
| 2,890,436 | A | 6/1959 | Bentley | |
| 3,836,947 | A | 9/1974 | Yeager | |
| 4,037,900 | A * | 7/1977 | Schmidger | 439/216 |
| 6,095,874 | A | 8/2000 | Quaranta | |

* cited by examiner

*Primary Examiner* — Khiem Nguyen
(74) *Attorney, Agent, or Firm* — Brian B. Shaw, Esq.; Jodi A. Reynolds, Esq.; Harter Secrest & Emery LLP

(57) ABSTRACT

An electrical connection assembly includes a faceplate defining a compartment extending substantially perpendicularly therefrom. The compartment being formed from the same piece of material as the faceplate and defining a biasing member biasing a component of the connection assembly. The electrical connection assembly also includes a one-piece conductive insert disposed within the compartment. The insert has a terminal enabling electrical connection of the insert to an electrical current source.

21 Claims, 9 Drawing Sheets

ELECTRICAL CONNECTION ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present disclosure generally relates to an electrical connection assembly and, in particular, to electrical receptacles and switches.

2. Description of Related Art

Electrical connection assemblies such as receptacles for conventional electrical plugs, and switches used to control, for example, room lighting and/or power to one or more outlets of a wall-mounted receptacle, are widely used in industrial and home applications for providing power to a variety of modern day equipment. For example, a two-way, three-way, or four-way, wall-mounted switch may be used in a home to control one or more lights electrically connected to the switch. Similarly, wall-mounted receptacles may have one or more outlets configured to receive, for example, the prongs of a typical electrical plug. Such an electrical plug may be connected to a variety of electrical components such as, for example, televisions, computers, microwave ovens, and toasters, to facilitate providing electrical power thereto.

Such known electrical connection assemblies are typically formed of several parts. For example, a junction box is typically mounted to a wall stud behind, for example, a sheet of drywall. An electrical service wire is then connected to the junction box whereby positive, negative, and ground wires of the electrical service wire are configured to mate with terminals of the switch or receptacle within the junction box. Typical switches and receptacles also include assemblies for receiving the prongs of an electrical plug that are manufactured separate from the terminals and later electrically connected to the terminals via a known linkage. These separate components can be difficult and time consuming to manufacture.

In addition, once the service wires have been connected to the terminals, the switch or receptacle is connected to the junction box by two or more screws. A face plate is then connected to the switch or receptacle as a decorative cover mating with the dry wall. Securing such a face plate to the switch or receptacle after the switch or receptacle is mounted to the junction box, however, adds a step to the installation process, and increases the time, cost, and complexity of installing such known switches or receptacles. For these reasons, manufacturing known devices can be costly and cumbersome. In addition, installing such devices can be time-consuming, particularly in situations where multiple devices are required such as, for example, in wiring a new office building, or in rewiring an existing home or office building.

It is, therefore, an object of the present disclosure to overcome the above difficulties as well as other problems associated with known electrical connection assemblies.

BRIEF SUMMARY OF THE INVENTION

In an exemplary embodiment of the present disclosure, an electrical connection assembly includes a faceplate defining a compartment extending substantially perpendicularly therefrom, the compartment being formed from the same piece of material as the faceplate and defining a biasing member biasing a component of the connection assembly. The electrical connection assembly also includes a one-piece conductive insert disposed within the compartment, the insert having a terminal enabling electrical connection of the insert to an electrical current source.

In an additional exemplary embodiment of the present disclosure, an electrical connection assembly includes a faceplate defining a compartment extending perpendicularly therefrom, the compartment being formed from the same piece of material as the faceplate. The electrical connection assembly also includes a first one-piece conductive insert disposed within the compartment and having a first terminal enabling electrical connection of the first insert to an electrical current source, and a second one-piece conductive insert disposed within the compartment and having a second terminal enabling electrical connection of the second insert to the electrical current source. The second insert is electrically disconnected from the first insert. The electrical connection assembly further includes a plurality of biasing members formed from by at least one wall of the compartment, the plurality of biasing members being in contact with at least one of the first and second inserts.

In a further exemplary embodiment, an electrical connection assembly includes a faceplate defining a compartment extending perpendicularly therefrom, the compartment being formed from the same piece of material as the faceplate. The electrical connection assembly also includes a one-piece conductive insert disposed within the compartment, the insert having a first terminal enabling electrical connection of the insert to an electrical current source. The electrical connection assembly further includes a second terminal disposed within the compartment and configured for electrical connection to the electrical current source. The electrical connection assembly also includes a bridge disposed within the compartment and electrically connected to the first terminal, the bridge being pivotally moveable between an open position electrically disconnected from the second terminal and a closed position electrically connected to the second terminal. The electrical connection assembly also includes a biasing member formed from by a wall of the compartment, the biasing member assisting in biasing the bridge in at least one of the open and closed positions.

In an additional exemplary embodiment, a method of manufacturing an electrical connection assembly includes forming a faceplate defining a compartment formed from the same piece of material as the faceplate, the compartment including at least one biasing member formed integrally therewith, and disposing a one-piece conductive insert within the compartment, the insert having a terminal, and a connector enabling electrical connection of the terminal to an electrical current source. The method also includes forming first and second orifices in the compartment, the first orifice providing access to the terminal and the second orifice providing access to the connector.

BRIEF DESCRIPTION OF THE SEVERAL VIEWS OF THE DRAWING(S)

DETAILED DESCRIPTION OF THE INVENTION

Figure 1:
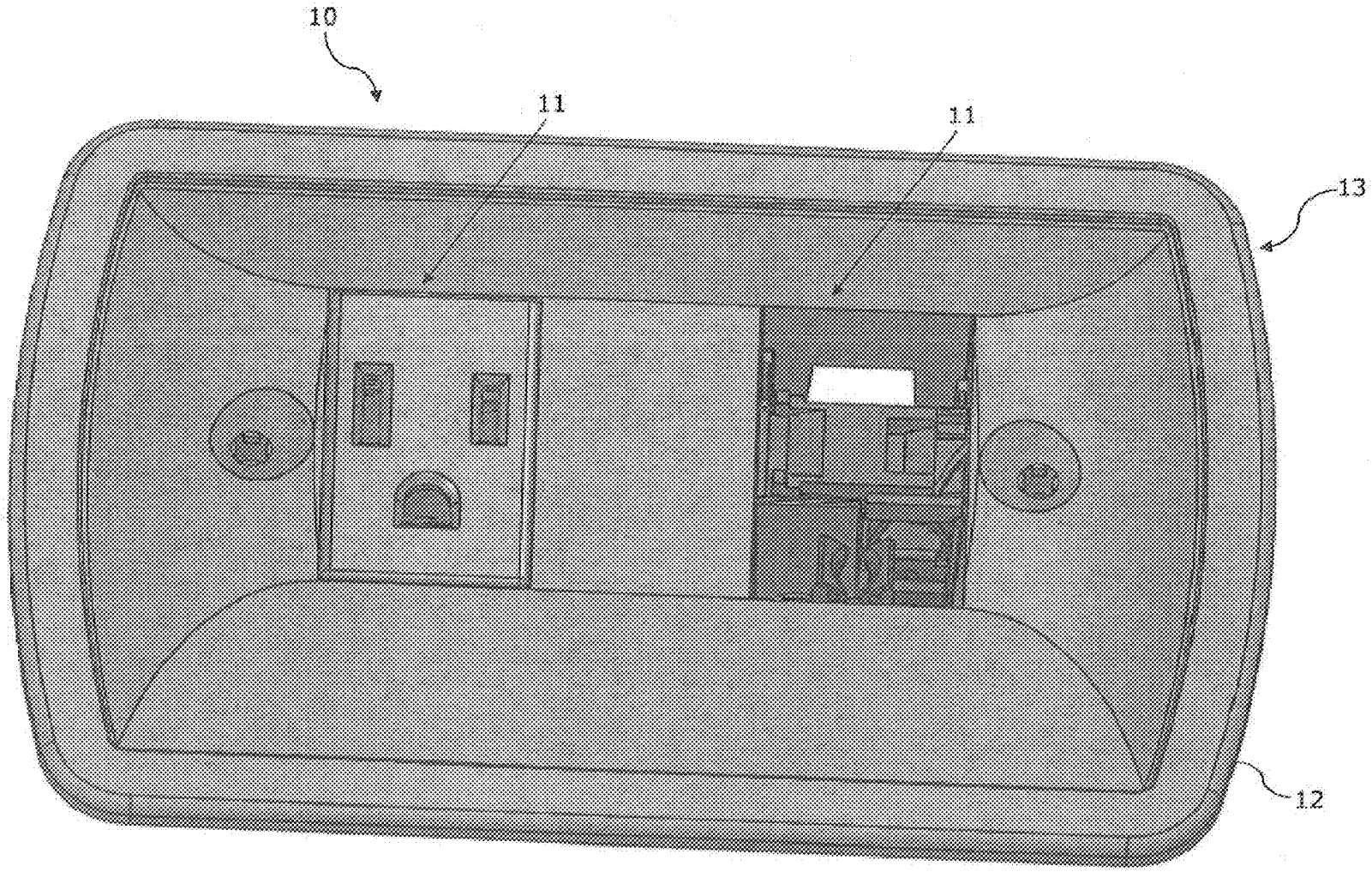
FIG. 1 illustrates an electrical connection assembly, with portions removed, according to an exemplary embodiment of the present disclosure.

An electrical connection assembly of the present disclosure may be, for example, a wall-mountable receptacle having one or more outlets 11, a two-way, three-way, or four-way switch, or any other electrical connection assembly known in the art. For example, as shown in FIG. 1, in an exemplary embodiment an electrical connection assembly 10 may comprise a face plate 12 having at least one outlet 11. In additional exemplary embodiments, the electrical connection assembly 10 may include two or more outlets 11, and the outlets 11 of the electrical connection assembly 10 may or may not include components configured to receive and/or connect electrically with a ground prong of a common electrical plug.

As will be discussed in greater detail below, the outlets 11 of the electrical connection assembly 10 may be configured to receive positive, negative, and/or ground prongs of known electrical plugs for transmitting power in the form of an electrical current to such plugs. Such current may be, for example, 60 amps and 120 volts. Alternatively, the current provided by the exemplary electrical connection assemblies 10 described herein may have any other electrical and/or electromechanical properties known in the art.

Figure 2:
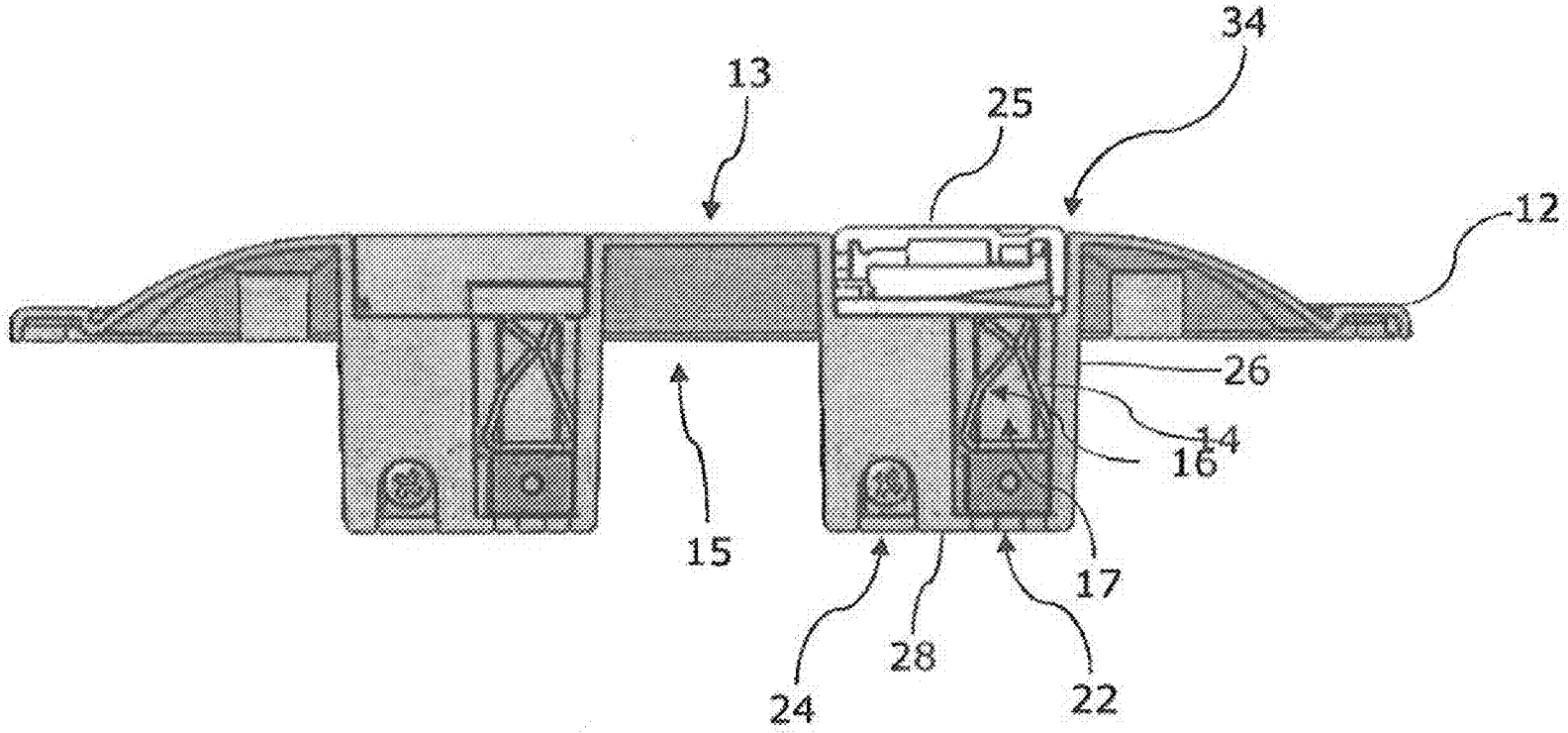
FIG. 2 is a cross-sectional view of the electrical connection assembly illustrated in FIG. 1.

The face plate 12 may be made from, for example, plastic, rubber, polymers, and/or any other substantially insulative material known in the art. The face plate 12 may be, for example, injection molded, extruded, cast, and/or otherwise formed to have a one-piece construction. As shown in FIG. 2, the face plate 12 may be substantially planar and may define at least one compartment 17 extending substantially perpendicularly therefrom. For example, the face plate 12 may define a front surface 13 and a back surface 15, and a compartment 17 may extend substantially perpendicularly from the front surface 13 and/or the back surface 15. The compartment 17 may include at least one wall 26 and, in an exemplary embodiment, the compartment 17 may comprise four walls 26 and a base 28. It is understood, that the base 28 may be a wall 26 of the compartment 17. The compartment 17 may be formed from the same piece of material as the face plate 12 and, thus, each of the walls 26 and the base 28 may be formed from the same piece of material as the face plate 12 such that the face plate 12 has a one-piece construction.

The compartment 17 may also define at least one biasing member 14. The biasing member 14 may bias one or more components of the electrical connection assembly 10, and may be formed from the same piece of material as, for example, the face plate 12 and the compartment 17. In an exemplary embodiment, the one or more biasing members 14 may be injection molded, extruded, cast, and/or otherwise formed as part of the compartment 17. In an exemplary embodiment, the biasing member 14 may be formed from a wall 26 or base 28 of the compartment 17, so as to extend therefrom. In such exemplary embodiments, the biasing member 14 may be in contact with one or more components of the electrical connection assembly 10 so as to provide a biasing force to the component. The biasing member 14 may be, for example, a ridge, rib, notch, ledge, diaphragm, bump, and/or other known structure useful in biasing, for example, electrical connection components. The biasing member 14 may be substantially flexible so as to provide a spring-like biasing force to one or more components of the electrical connection assembly 10. Alternatively, the biasing member 14 may be substantially rigid so as to provide a biasing force to, for example, substantially flexible components of the electrical connection assembly 10. It is understood, that in an exemplary embodiment, the biasing member 14 may bias components of the electrical connection assembly 10 through physical and/or mechanical contact with such components. Since it is made from the same piece of material as, for example, the face plate 12, wall 26, and/or base 28, the biasing member 14 may be substantially electrically insulative.

The biasing member 14 may have any shape, size, and/or other configuration to assist in providing a biasing force to one or more components of the electrical connection assembly 10. For example, as shown in FIG. 2, the electrical connection assembly 10 may include one or more inserts 16 disposed within the compartment 17, and the biasing member 14 may bias, for example, a first opposed arm 30 of the insert 16 toward a second opposed arm 32 of the insert 16. Alternatively, as will be discussed in greater detail below, in additional exemplary embodiments an electrical connection assembly 10 may include a conductive bridge having one or more legs, and one or more biasing members 14 may be configured to apply a biasing force to the one or more legs.

As shown in FIG. 2, the insert 16 may be, for example, a one-piece conductive insert disposed within the compartment 17. As mentioned above, and as illustrated in greater detail in FIGS. 3 and 4, the insert 16 may include first and second opposed arms 30, 32. Each of the arms 30, 32 may define at least one respective slot 31, 33. The slots 31, 33 may be shaped, sized, located, and/or otherwise configured to accept, for example, a corresponding biasing member 14 such that when the insert 16 is disposed within the compartment 17, biasing members 14 are disposed within the slots 31, 33 to bias the arms 30, 32 toward each other. Such a configuration may provide additional support and/or strength to the arms 30, 32. Such a configuration may also make the electrical connection assembly 10 more robust, and may increase the contact pressure applied to, for example, the prongs of an electrical plug inserted between the arms 30, 32 of the electrical connection assembly 10.

The insert 16 may be made from any conductive material known in the art such as, brass, copper, aluminum, and/or alloys thereof. In an exemplary embodiment, the insert 16 may be stamped, cut, etched, bent, and/or otherwise formed from a single piece of such material. An insert 16 may be shaped, sized, and/or otherwise formed to have any shape known to assist in forming, for example, an electrical connection between the arms 30, 32 and a prong of a common electrical plug. For example, each outlet 11 may have a first insert 16 configured to receive a positive prong of an electrical plug and a second insert 16 configured to receive a negative prong of the electrical plug. In additional exemplary embodiments, an outlet 11 may also include a third insert 16 configured to receive a ground prong of the electrical plug. Such an exemplary embodiment is illustrated in, for example, FIG. 1.

Figure 3:
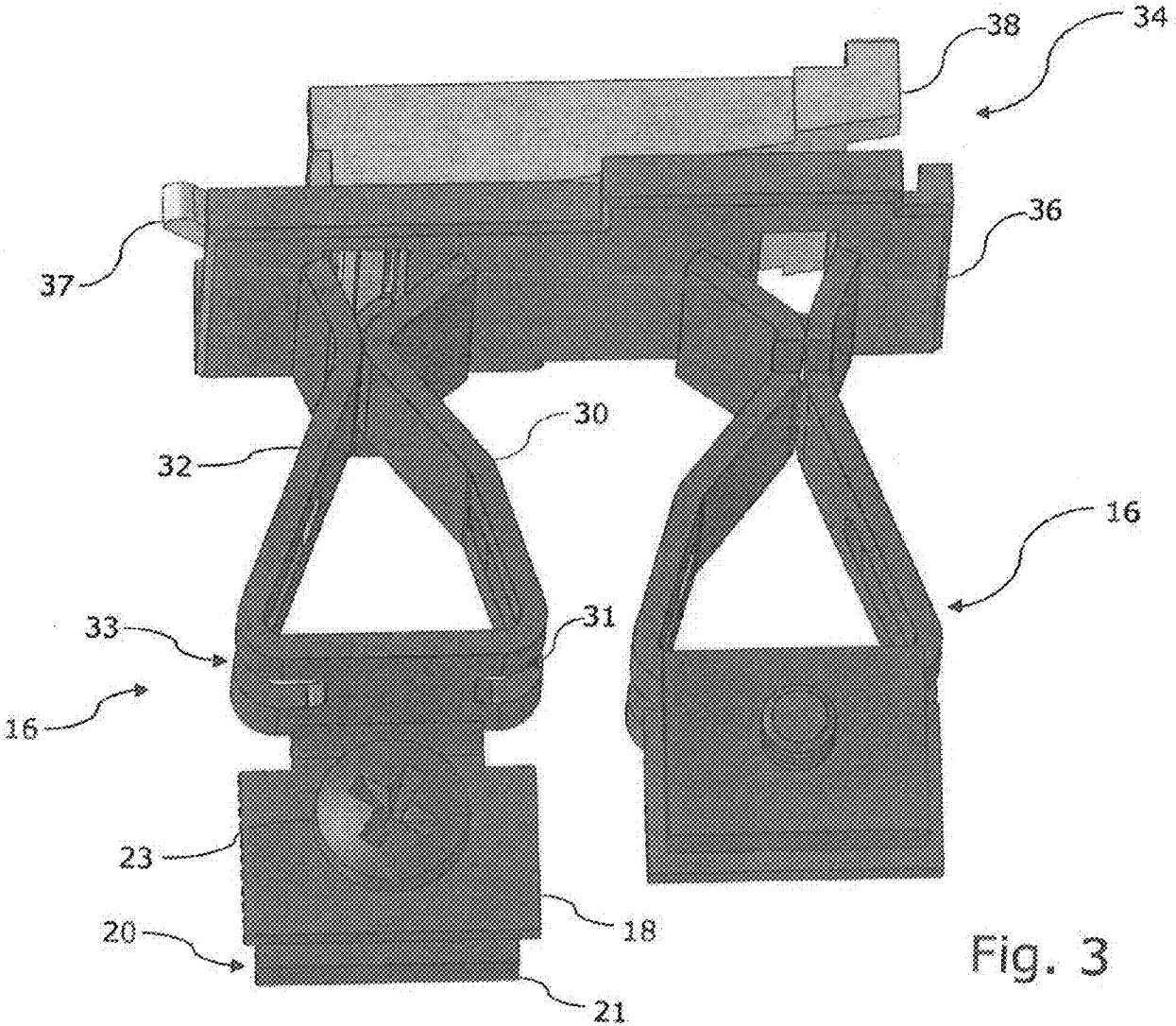
FIG. 3 is an isometric view of a pair of inserts and a lock assembly according to an exemplary embodiment of the present disclosure.
Figure 4:
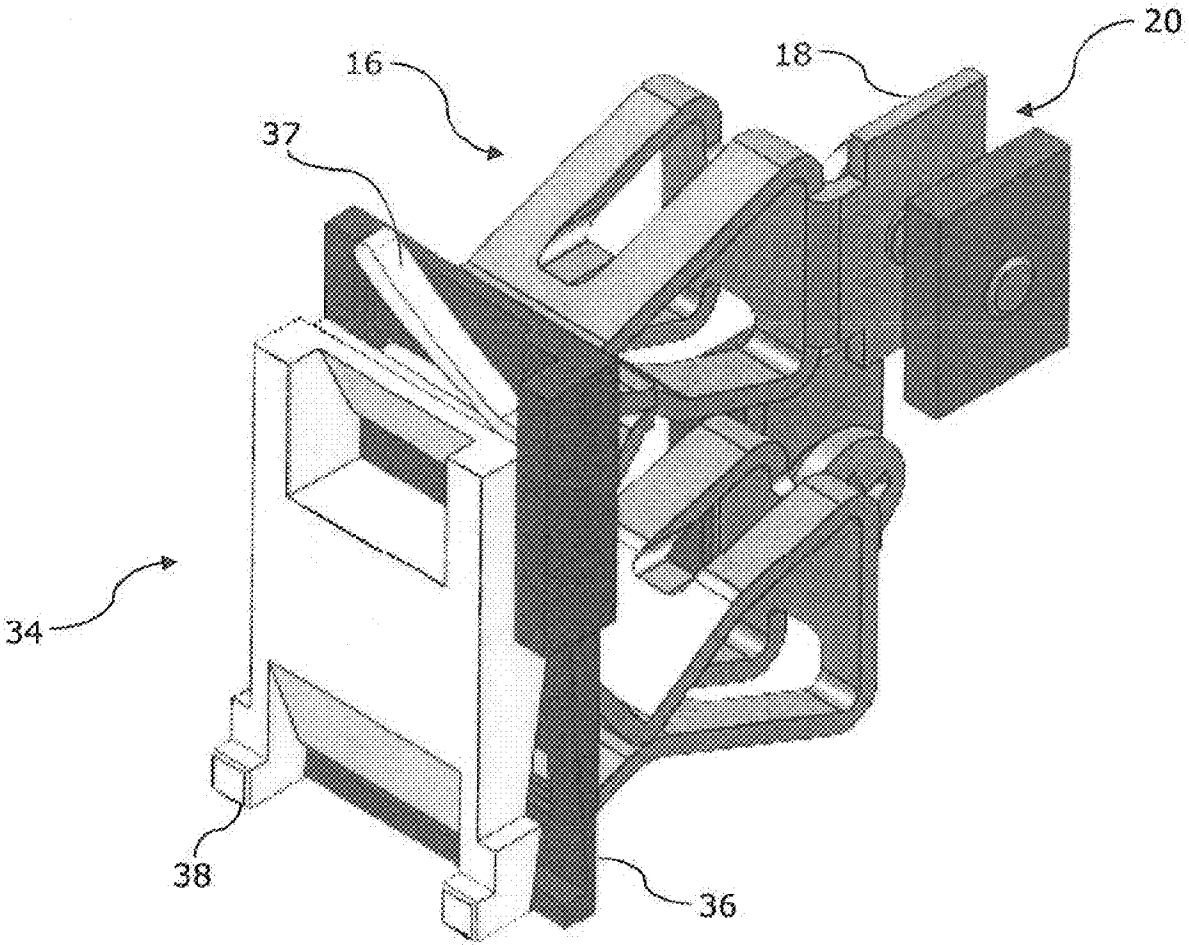
FIG. 4 is an alternate isometric view of the inserts and lock assembly illustrated in FIG. 3.
Figure 5:
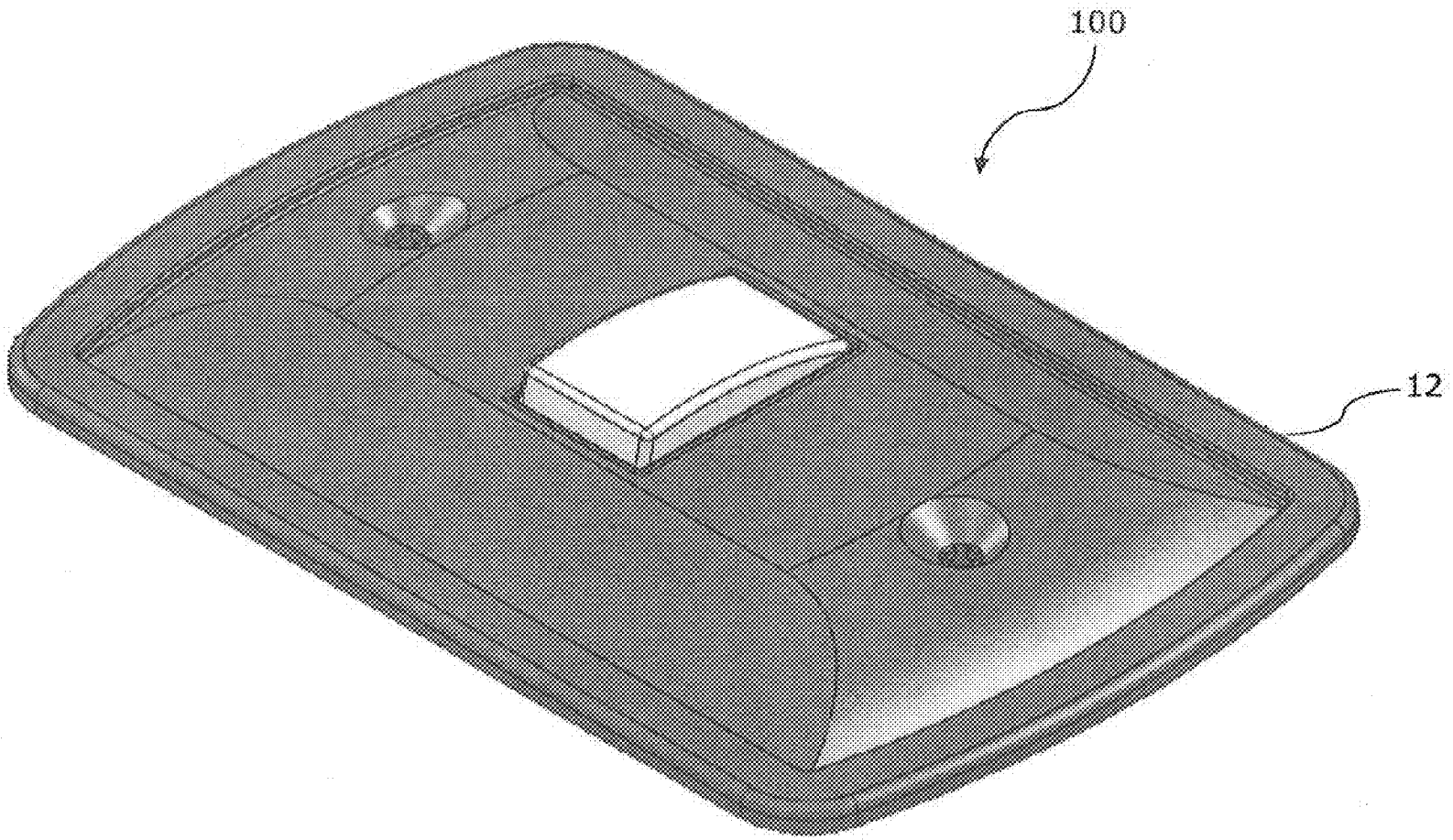
FIG. 5 illustrates and electrical connection assembly according to another exemplary embodiment of the present disclosure.

With continued reference to FIGS. 3 and 4, the insert 16 may include a terminal 18 enabling electrical connection of the insert 16 to an electrical current source such as, for example, an electrical service wire. The insert 16 and/or the terminal 18 may further include a connector 20. The connector 20 may be configured to assist in mechanically and/or electrically connecting the electrical current source to the terminal 18. The connector 20 may be of any known configuration and, in an exemplary embodiment, the connector 20 may comprise a plate 21 connected to the terminal 18 by a screw 23. In such an exemplary embodiment, an electrical current source such as, for example, the conductive core of an electrical service wire may be disposed between the plate 21 and the terminal 18, and the screw 23 may be turned in a clockwise direction through a threaded hole in the terminal 18 to draw the plate 21 towards the terminal 18. Such motion of the plate 21 may clamp the conductive core to the terminal 18 thereby completing a circuit between the core of the electrical service wire and the terminal 18 through which electrical current may flow. Although it is described herein as comprising a plate 21 and a screw 23, it is understood that the connector 20 may have any other alternative configuration known in the art.

As shown in FIG. 2, the compartment 17 may define at least one orifice providing access to the terminal 18 and/or the connector 20 to facilitate connecting the terminal 18 to, for example, the electrical current source discussed above. In an exemplary embodiment, a first wall 26 may be substantially perpendicular to a second wall 26 of the compartment 17 and the first wall 26 may define a first orifice 22 providing access to the terminal 18 wherein the second wall 26 may define a second orifice 24 providing access to the connector 20. As discussed above, in a further exemplary embodiment, the base 28 of the compartment 17 may be a wall of the compartment 17, and the base 28 may be substantially perpendicular to a wall 26 of the compartment 17. In such an exemplary embodiment, as shown in FIG. 2, the base 28 may define the first orifice 22 providing access to the terminal 18 for, for example, insertion of the conductive core of an electrical service wire between the terminal 18 and the plate 21 of the connector 20. In such an exemplary embodiment, the wall 26 substantially perpendicular to the base 28 may define a second orifice 24 providing access to the screw 23 of the connector 20 to facilitate clamping the core of the electrical service wire between the plate 21 and the terminal 18. It is understood that the compartment 17 may define at least two orifices for each insert 16 disposed therein. For example, in an exemplary embodiment in which three inserts 16 are disposed within the compartment 17 (a first insert 16 configured to receive a positive prong of an electrical plug, a second insert 16 configured to receive a negative prong of the electrical plug, and a third insert 16 configured to receive a ground prong of the electrical plug), the compartment 17 may define a total of six or more orifices. Such orifices may be configured to provide access to the respective terminals 18 and connectors 20 of the inserts 16 disposed within the compartment 17.

In an exemplary embodiment, the electrical connection assembly 10 may also include a lock assembly 34. The lock assembly 34 may be disposed, for example, within the compartment 17 and may be configured to prohibit insertion of a first structure between a first pair of opposed arms 30, 32 disposed within the compartment 17 unless a second structure is substantially simultaneously inserted between a second pair of opposed arms 30, 32 disposed within the compartment 17. The lock assembly 34 may be, for example, a child-proof device configured to protect against electrocution should a child or other user of the electrical connection assembly 10 insert a conductive structure into only one opening of the outlet 11.

In an exemplary embodiment, the lock assembly 34 may comprise a base 36, and a stop 38 slideably and/or otherwise moveably connected to the base 36. The lock assembly 34 may further comprise a lever 37 configured to bias, for example, the stop 38. In an exemplary embodiment, the base 36 may define an orifice located over and/or otherwise aligned with the arms 30, 32 of a corresponding insert 16 disposed within the compartment 17. It is understood that such orifices may be configured to receive the prongs of a known electrical plug. When fully assembled, the lever 37 may contact a portion of the face plate 12 and/or the compartment 17 to bias the stop 38 into a position covering the orifices of the base 36. In such a position, the stop 38 may prohibit insertion of a structure between only one set of arms 30, 32 without substantially simultaneous insertion of a second structure between the second set of arms 30, 32. The stop 38 may, however, be configured to receive both prongs of such an electrical cord substantially simultaneously, and such substantially simultaneous insertion thereof may cause the stop 38 to slide relative to the base 36 against the biasing force of the lever 37. Such sliding of the stop 38 may expose the orifices of the base 36 and enable the user to insert the prongs, for example, between the respective arms 30, 32 disposed beneath the orifices of the base 36. The base 36 and/or the stop 38 of the lock assembly 34 may be made from any materials known in the art and, in an exemplary embodiment, the components of the lock assembly 34 may be made from one or more of the materials discussed above with respect to the face plate 12.

FIGS. 5-9 illustrate an electrical connection assembly 100 according to an additional exemplary embodiment of the present disclosure. Wherever possible, the same reference numerals utilized to describe the exemplary embodiment illustrated in FIGS. 1-4 have been used in FIGS. 5-9 to describe like parts. In the embodiment illustrated in FIGS. 5-9, the electrical connection assembly 100 may comprise, for example, an electrical toggle switch, an on/off switch, a push button switch, and/or any other electrical switch mechanism known in the art. Similar to the electrical connection assembly 10 discussed above with respect to FIGS. 1-4, the electrical connection assembly 100 may include a face plate 12 defining a compartment 17 extending substantially perpendicular therefrom.

Figure 6:
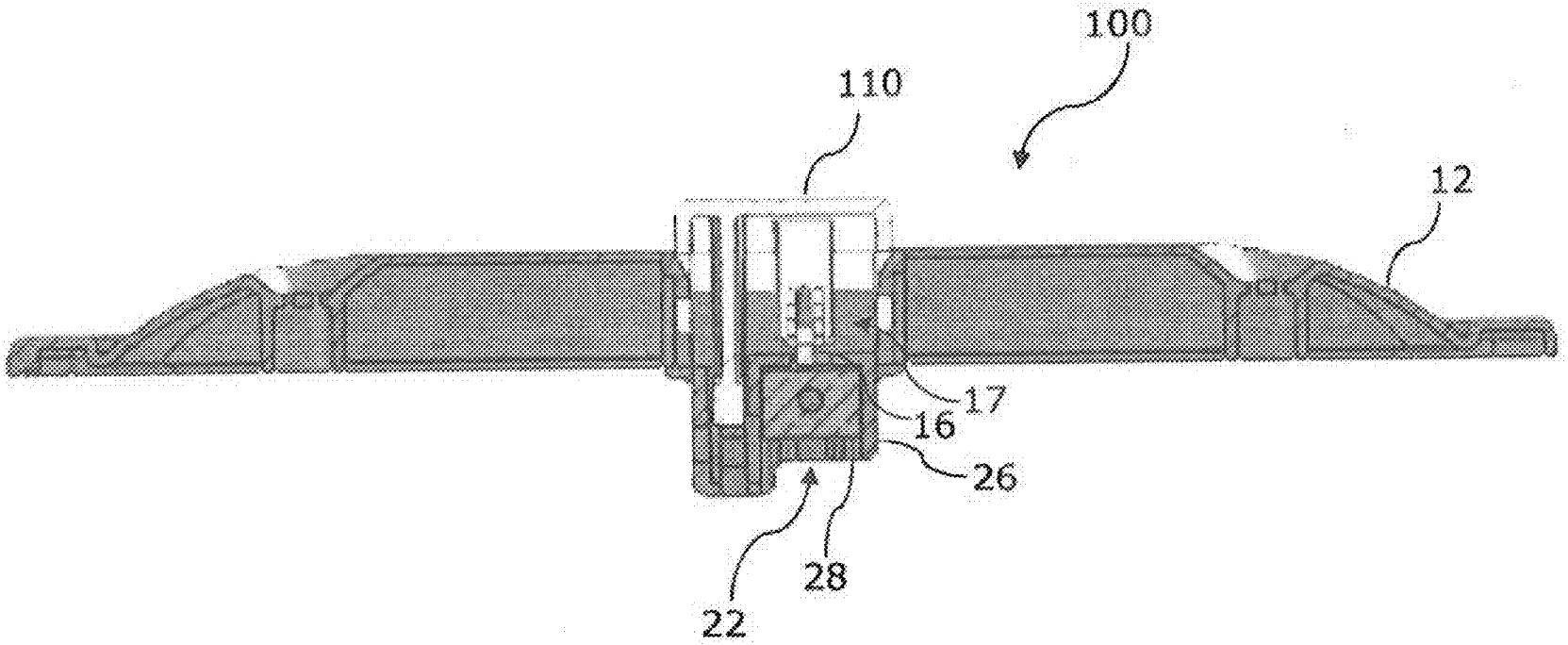
FIG. 6 is a cross-sectional view of the electrical connection assembly of FIG. 5.
Figure 7:
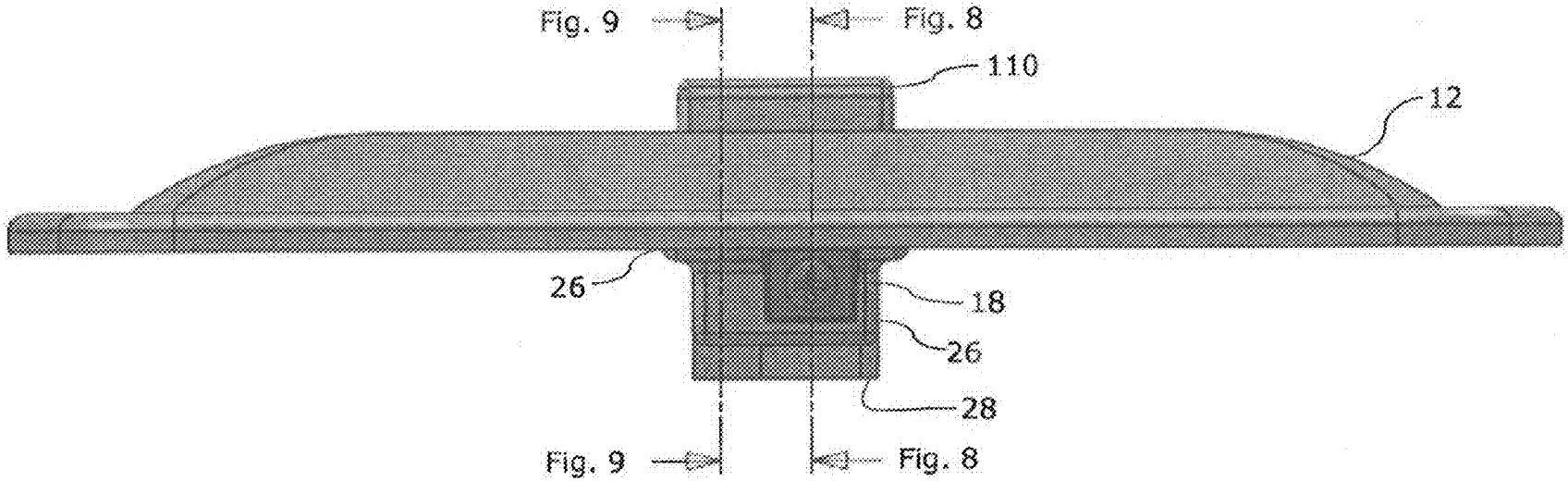
FIG. 7 is a side view of the electrical connection assembly of FIG. 5.
Figure 8:
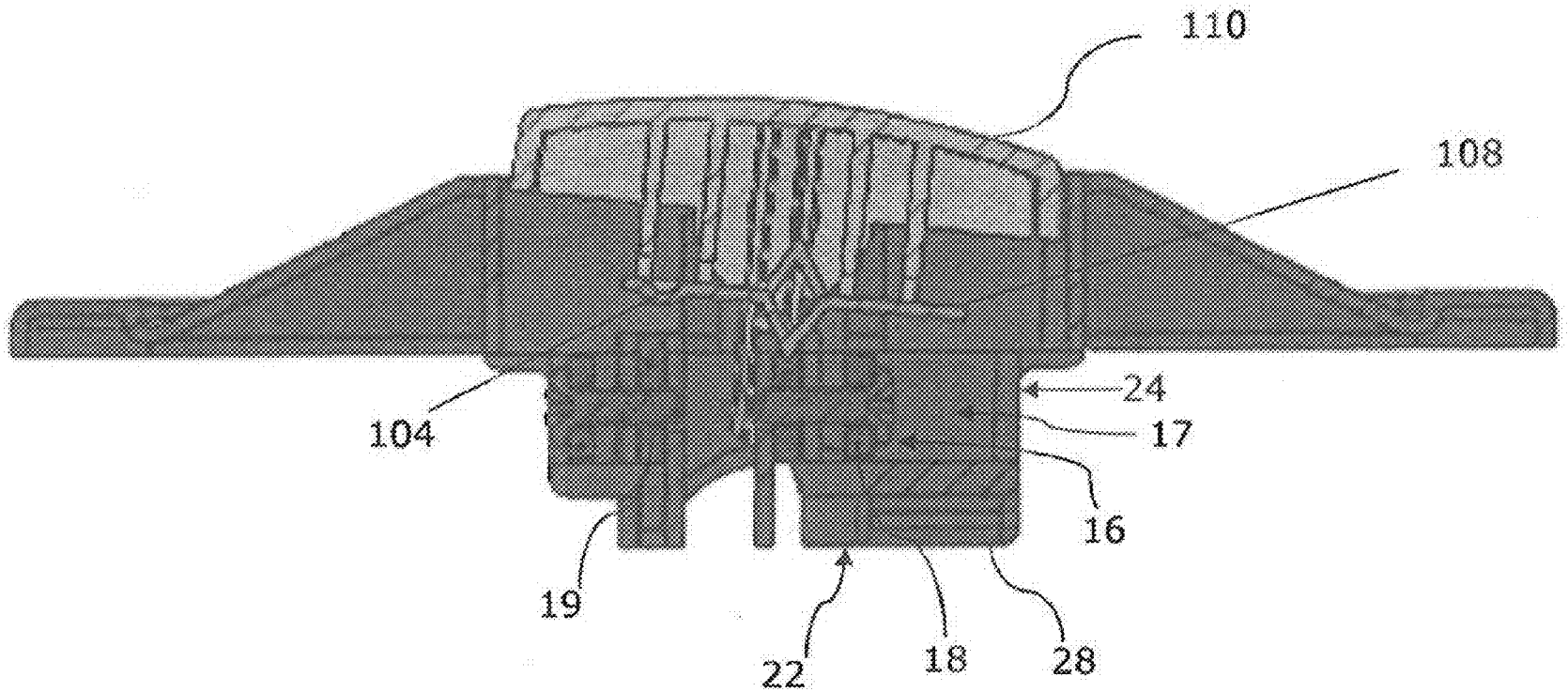
FIG. 8 is a cross-sectional view of the electrical connection assembly of FIG. 7.
Figure 9:
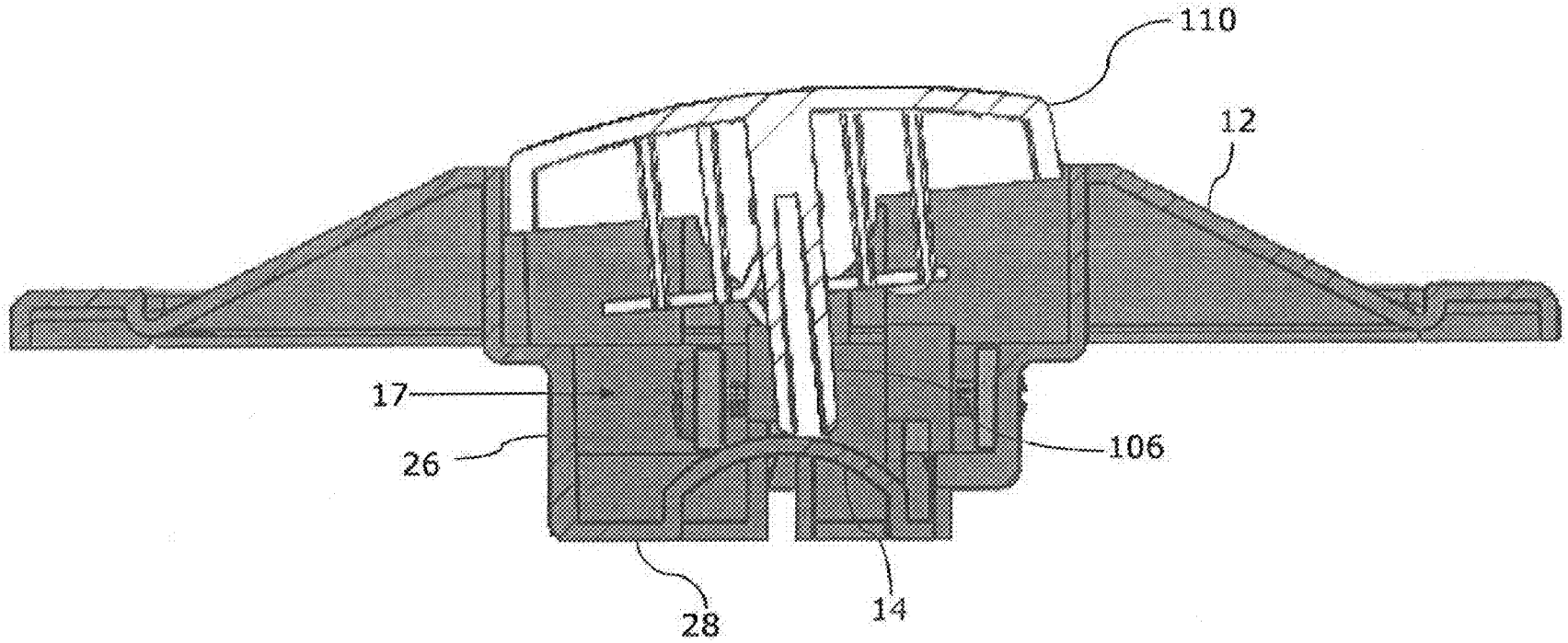
FIG. 9 is another cross-sectional view of the electrical connection assembly of FIG. 7.

As shown in FIG. 6, the compartment 17 may be disposed substantially in the middle of the face plate 12, and the compartment 17 may be formed from the same piece of material as the face plate 12. As best seen in FIG. 9, the compartment 17 of the electrical connection assembly 100 may define at least one biasing member 14 biasing, for example, a component of the electrical connection assembly 100. As will be described in greater detail below, in an exemplary embodiment, the biasing member 14 may bias a leg 106 of an actuator 110. With further reference to FIG. 6, the electrical connection assembly 100 may further comprise a one-piece conductive insert 16 disposed within the compartment 17. As discussed above with respect to the electrical connection assembly 10, the insert 16 of the electrical connection assembly 100 may have a terminal 18 (FIG. 7) enabling electrical connection of the insert 16 to an electrical current source such as, for example, a conductive core of an electrical service wire. As illustrated in FIGS. 6-8, the compartment 17 may comprise, for example, walls 26, a base 28, and orifices 22, 24 similar to those described above with respect to the electrical connection assembly 10.

As shown in the cross-section of FIG. 8, the insert 16 of the electrical connection assembly 100 may further include a bridge 108. The bridge 108 may be electrically connected to, for example, the terminal 18 of the insert 16, and the bridge 108 may be pivotally moveable with respect to the terminal 18. The bridge 108 may be made from any conductive material known in the art such as, for example, any of the materials discussed above with respect to the insert 16. The bridge 108 may be substantially planar and may include, for example, a mating surface 104 configured to mate with and/or otherwise form an electrical connection with, for example, a second terminal 19 disposed within the compartment 17. The bridge 108 may have any shape, size, and/or other configuration in order to maintain an electrical connection between the bridge 108 and the terminal 18 while being pivotally moveable with respect to the terminal 18 within the compartment 17. The bridge 108 may be electrically connected to the terminal 18 via, for example, one or more soldered wires, joints, or other flexible electrical connections known in the art. Alternatively, the bridge 108 and the terminal 18 may be formed from the same piece of material.

The bridge 108 may be positioned within the compartment 17 and/or supported by the walls 26, base 28, and/or other structures of the compartment 17 to facilitate pivotal movement between, for example, a first position electrically disconnected from the additional terminal 19, and a second position electrically connected to the additional terminal 19. In an exemplary embodiment, the mating surface 104 of the bridge 108 may be separated from the terminal 19 when the bridge 108 is in the first position, and the mating surface 104 may be in contact with the terminal 19, thereby forming a closed electrical circuit with the terminal 19, when the bridge 108 is in the second position. It is understood that the terminal 18 may be part of a first one-piece conductive insert 16 disposed within the compartment 17 while the terminal 19 may be part of a second one-piece conductive insert 16 disposed within the compartment 17. It is also understood that in an additional exemplary embodiment, the bridge 108 may be hingedly, pivotally, and/or otherwise moveably mounted to a component of the insert 16 such as, for example, the terminal 18. In such an exemplary embodiment, the bridge 108 may pivot at the connection with the terminal 18 to transition between the first position electrically disconnected from the terminal 19 and the second position electrically connected to the terminal 19.

The electrical connection assembly 100 may further include an actuator 110 connected to the bridge 108. The actuator 110 may enable movement of the bridge 108 between the first and second positions discussed above. The actuator 100 may be made from any of the insulative materials discussed above with respect to, for example, the face plate 12 such that a user manipulating the actuator 110 may be electrically insulated from, for example, an electrical current flowing across the bridge 108 between the terminal 18 and the terminal 19.

As shown in FIG. 9, the actuator 110 may comprise a leg 106 connected thereto. The leg 106 may extend from the actuator 110 and, in an exemplary embodiment, the leg 106 may be in mechanical contact with at least a portion of the biasing member 14. As shown in FIG. 9, the biasing member 14 may have any desirable cross-section configured to assist in applying a biasing force to, for example, the leg 106. Such a biasing force may assist in biasing, for example, the bridge 108 in at least one of the first position and second position discussed above. In an exemplary embodiment, the biasing member 14 may have a substantially semi-circular, substantially rounded, substantially ovular, substantially rectangular, substantially square, and/or any other desirable cross-section known in the art to facilitate applying such a biasing force to the leg 106.

In an exemplary embodiment shown in FIG. 9, the biasing member 14 may be flexible relative to the leg 106. In such an exemplary embodiment, movement of the leg 106 across the surface of the biasing member 14 may deflect at least a portion of the biasing member 14. In such an exemplary embodiment, the leg 106 may deflect the biasing member 14 until the leg 106 is moved from a first side of a peak of the biasing member 14 to a second opposed side of the peak. Alternatively, in the embodiment illustrated in FIG. 4, the leg 106 may be flexible relative to the biasing member 14 such that the leg 106 deflects when the bridge 108 is transitioned between the first and second positions discussed above. It is also understood that the biasing member 14 of the electrical connection assembly 100 illustrated in FIG. 9 may be formed by the base 28 of the compartment 17 and, in the embodiment of FIG. 9, the base 28 may be a wall of the compartment 17. It is also understood that in such an exemplary embodiment, the first position discussed above wherein the bridge 108 is electrically disconnected from the terminal 19 may be an open position, and the second position discussed above in which the bridge 108 is electrically connected to the terminal 19 may be a closed position. Moreover, although FIG. 9 illustrates the leg 106 extending substantially perpendicularly from the actuator 110, it is understood that the leg 106 may extend at any desirable angle relative to the actuator 110 to obtain a desired interaction with and biasing by the biasing member 14.

Although components of the electrical connection assemblies 10, 100 have been discussed above as being formed through injection, molding, casting, or extrusion processes, it is understood that the components of such assemblies may be formed through any additional manufacturing process known in the art. For example, the electrical connection assemblies 10, 100, and their components, may be manufactured by forming a face plate 12 defining a compartment 17 formed from the same piece of material as the face plate 12. As discussed above, the compartment 17 may include at least one biasing member 14 formed integrally therewith. Once formed, a one-piece conductive insert 16 may be disposed within the compartment 17. As discussed above, the insert 16 may have a terminal and a connector enabling electrical connection of the terminal to an electrical current source. A plurality of orifices may also be formed in the compartment 17. At least one of the orifices may provide access to the terminal of the insert 16 and at least one additional orifice may provide access to the connector of the insert 16.

The electrical connection assemblies 10, 100 of the present disclosure overcome many of the deficiencies of known assemblies. For example, the face plate 12 and insert 16 each have a one-piece construction, thereby reducing the amount of material needed and the amount of material wasted during the manufacture of the electrical connection assembly. In addition, because the inserts 16 are disposed within the compartment 17 of the face plate 12 during manufacturing, the electrical connection assemblies 10, 100 described herein are quicker and easier to install than known assemblies. In particular, after connecting electrical service wires to the terminal 18 of the insert 16, the installer may simply attach the face plate 12 directly to a junction box mounted to a wall stud or other structure. Since the insert 16 is disposed within the face plate 12, the installer need not perform the extra step of installing a face plate 12 after connecting electrical service wires to the terminal and connection the receptacle or switch to the junction box, as is typical with known assemblies. Thus, the electrical connection assemblies 10, 100 of the present disclosure will result in a substantial cost savings during manufacture as well as a substantial time savings during installation over known assemblies.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. An electrical connection assembly, comprising:

a faceplate defining a compartment extending substantially perpendicularly therefrom, the compartment being formed from the same piece of material as the faceplate and defining a biasing member biasing a component of the connection assembly; and a one-piece conductive insert disposed within the compartment, the insert having a terminal enabling electrical connection of the insert to an electrical current source.

2. The assembly of claim 1, wherein the compartment defines a first orifice providing access to the terminal.

3. The assembly of claim 2, wherein the insert further includes a connector and the compartment further defines a second orifice, the first orifice providing access to the terminal and second orifice providing access to the connector.

4. The assembly of claim 3, wherein the compartment includes a first wall substantially perpendicular to a second wall, the first wall defining the first orifice and the second wall defining the second orifice.

5. The assembly of claim 1, wherein compartment includes at least one wall, the biasing member being formed integrally with the wall and extending from the at least one wall to contact the component.

6. The assembly of claim 1, wherein the insert includes a pair of opposed arms connected to the terminal and configured to receive a prong of an electrical plug.

7. The assembly of claim 6, wherein the biasing member biases at least one of the opposed arms toward the other of the opposed arms.

8. The assembly of claim 1, wherein the insert is a first insert including a first pair of opposed arms, the assembly further comprising a second insert including a second pair of opposed arms, each of the first and second pairs being configured to receive a prong of an electrical plug.

9. The assembly of claim 8, further including a lock assembly disposed within the compartment, the lock assembly prohibiting insertion of a first structure between the first pair of opposed arms unless a second structure is substantially simultaneously inserted between the second pair of opposed arms.

10. The assembly of claim 9, the lock assembly including a base and a stop, the base defining a first hole providing access to the first pair of opposing arms and a second hole providing access to the second pair of opposing arms, and the stop being movably connected to the base to substantially simultaneously uncover the first and second holes of the base.

11. The assembly of claim 1, the one-piece insert further including a bridge electrically connected to the terminal, the bridge being pivotally moveable with respect to the terminal.

12. The assembly of claim 11, further including an additional terminal, the bridge having a first position electrically disconnected from the additional terminal and a second position electrically connected to the additional terminal.

13. The assembly of claim 12, further including an actuator connected to the bridge, the actuator enabling movement of the bridge between the first and second positions.

14. The assembly of claim 13, wherein the component comprises a leg connected to the actuator.

15. An electrical connection assembly, comprising:

a faceplate defining a compartment extending perpendicularly therefrom, the compartment being formed from the same piece of material as the faceplate;

a first one-piece conductive insert being disposed within the compartment and having a first terminal enabling electrical connection of the first insert to an electrical current source;

a second one-piece conductive insert being disposed within the compartment and having a second terminal enabling electrical connection of the second insert to the electrical current source, the second insert being electrically disconnected from the first insert; and a plurality of biasing members formed from by at least one wall of the compartment, the plurality of biasing members being in contact with at least one of the first and second inserts.

16. The assembly of claim 15, wherein the first insert comprises a first pair of opposed arms configured to receive a positive prong of an electrical plug, and the second insert comprises a second pair of opposed arms configured to receive a negative prong of the plug.

17. The assembly of claim 16, wherein the plurality of biasing members applies a closing force to the first and second pair of opposed arms.

18. The assembly of claim 16, further including a lock assembly disposed within the compartment, the lock assembly prohibiting insertion of the positive prong between the first pair of opposed arms unless the negative prong is substantially simultaneously inserted between the second pair of opposed arms.

19. The assembly of claim 18, the lock assembly including a base and a stop, the base defining a first hole providing access to the first pair of opposing arms and a second hole providing access to the second pair of opposing arms, and the stop being movably connected to the base to substantially simultaneously uncover the first and second holes of the base.

20. The assembly of claim 19, further including a cover plate disposed over the lock assembly and substantially coplanar with a top surface of the face plate, the cover plate defining a positive prong slot providing access to the first hole of the base and a negative prong slot providing access to the second hole of the base.

21. A method of manufacturing an electrical connection assembly, comprising:

forming a faceplate defining a compartment formed from the same piece of material as the faceplate, the compartment including at least one biasing member formed integrally therewith;

disposing a one-piece conductive insert within the compartment, the insert having a terminal, and a connector enabling electrical connection of the terminal to an electrical current source, and forming first and second orifices in the compartment, the first orifice providing access to the terminal and the second orifice providing access to the connector.

* * * * *